US005518315A

United States Patent [19]

Nichols

[11] Patent Number: 5,518,315

[45] Date of Patent: May 21, 1996

[54] EXTERNAL BAG SUPPORT FRAME

[75] Inventor: Steven B. Nichols, Los Angeles, Calif.

[73] Assignee: K-Swiss Inc., a Delaware corporation, Chatsworth, Calif.

[21] Appl. No.: 286,343

[22] Filed: Aug. 5, 1994

[51] Int. Cl.[6] ..... B65D 30/10

[52] U.S. Cl. ..... 383/119; 383/18; 383/121

[58] Field of Search ..... 383/121, 121.1, 383/18, 119, 19; 190/126

[56] References Cited

U.S. PATENT DOCUMENTS

| | | | |
|---|---|---|---|
| 724,316 | 3/1903 | Morris et al. | 383/121 X |
| 1,729,318 | 9/1929 | Wunderlich | 383/18 X |
| 1,986,743 | 1/1935 | Musick | 383/18 |
| 2,746,582 | 5/1956 | Cart | 383/18 X |
| 3,121,452 | 2/1964 | Hyman | 383/121 X |
| 3,203,517 | 8/1965 | Stein | 190/126 |

FOREIGN PATENT DOCUMENTS

| | | | |
|---|---|---|---|
| 0155733 | 12/1981 | Japan | 383/121 |

*Primary Examiner*—Jes F. Pascua
*Attorney, Agent, or Firm*—Drucker & Sommers

[57] ABSTRACT

An external bag support frame for attachment to a bag with side walls and a bottom wall. The external bag support frame has perimeter walls for attachment to the bag's side walls by stitching, adhesive, or with detachable means such as hook and loop material. The frame provides the bag with additional rigidity and abrasion resistance. In one embodiment, webbing straps passable through slots in the perimeter walls provide bottom support for the bags bottom. In another embodiment, a bottom grid, unitary with the perimeter side walls, form the bottom support for the bag.

7 Claims, 4 Drawing Sheets

EXTERNAL BAG SUPPORT FRAME

BACKGROUND OF THE INVENTION

1. Field of the Invention

This invention pertains to the pack, sack, and bag arts and more particularly to an external bag support frame which can be attached to a pack, sack, bag, and the like to give it additional support.

2. Description of the Prior Art

Backpacks, bookbags, backsacks, and bucket styled bags made of relative flexible fabrics such as fabrics, plastics and leather are popular. In the case of packs and bags used to carry relatively heavy goods, such as books, leather is often used to reinforce the bottom of these bags to prevent the corners of books from wearing through and tearing the bags. However, the use of leather does not solve a companion problem frequently experienced, particularly, when many objects are carried. This is the tendency of books to jut out of the bottom of the bag and deform the sides of the bag.

In the case of backpacks and backsacks, this tendency makes the backpack relatively uncomfortable to wear and makes it somewhat difficult to remove books when the backpack or backsack is not sitting level on a flat surface. Even so, the contents often become jumbled.

Efforts have been made to provide containers with stiffer bottoms. However, none of these devices would be applicable to the backpack, bookbag, and backsack art.

U.S. Pat. No. 2,865,421 to Walsh discloses a dielectric telescoping bucket which has a non-conducting upper rim and canvas sides. The bottom of the bag is formed by a bottom piece which is sewn to the bottom region of the canvas sides. The bottom piece is formed of leather, but fiberboard, plastics, or other relatively rigid fabrics could be used. The bag bottom itself is formed by this bottom piece. This is basically the same approach as forming the bottom of the backpack from leather.

U.S. Pat. No. 2,335,359 to Rosenberg discloses a ladies compact, which has flexible side walls and a wood or plastic bottom portion, its sides into which the flexible side walls frictionally engage. A draw cord is used to close up the mouth of the bag. While this design is acceptable for cosmetic compacts, it would be too heavy and inflexible to incorporate into the design of a backpack, as separation of the bottom from the flexible side wall would likely present a problem.

U.S. Pat. No. 4,512,463 to Ward discloses a free-standing flexible container for fluids, i.e., used engine oil, which basically comprises a flexible liner bag with an open mouth, a drain spout for draining the oil therefrom, and an interiorly lying hoop of material to support the lower region of the sidewalls, with the plastic liner being in direct contact with the ground. The device of Ward offers no bottom support to its liner. Two obvious drawbacks presented by this design includes one, a decreased interior volume by placing the hoop of rigid materials inside of the bag, and two, no improved abrasion resistance provided to the outside of the bag. There accordingly remains a need for a way to address these shortcomings. Also, there exists a need for a means for end users to retrofit existing backpacks, backsacks, so they are stronger and less subject to tearing and deformation during use.

SUMMARY OF THE INVENTION

The invention provides an external bag support frame for attachment to a bag, said bag having a bottom wall and side walls defining a bottom region, said bag support frame comprising:

a frame member having perimeter walls for attachment to the bag side walls near its bottom wall with attachment means, said frame member thereby providing the bag with additional rigidity and abrasion resistance.

DETAILED DESCRIPTION OF THE INVENTION

Figure 1:
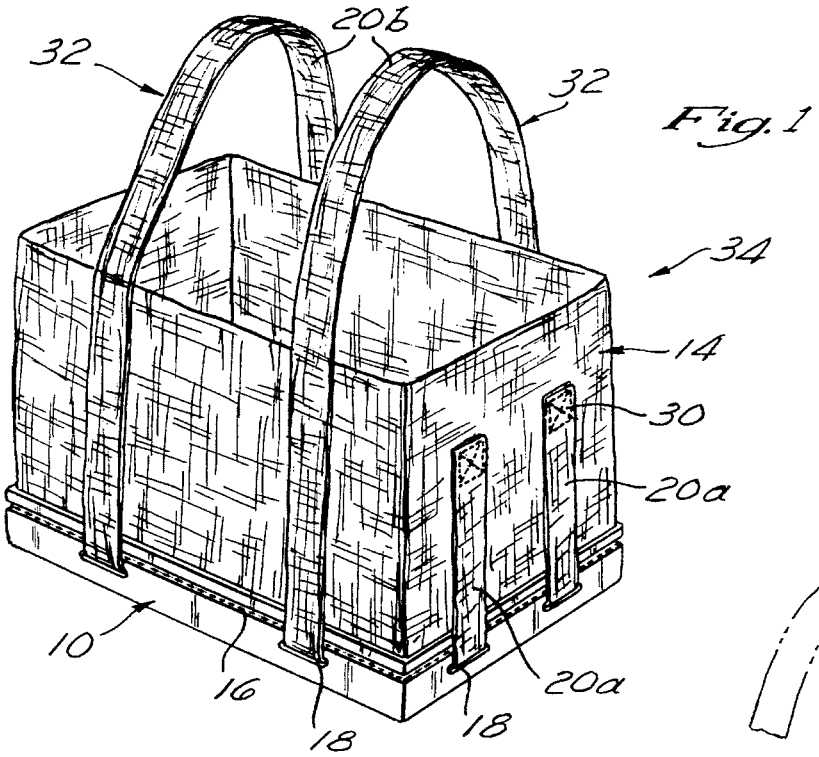
FIG. 1 is a perspective view of a first embodiment of an external bag support frame of the invention, attached to an open topped bag.
Figure 2:
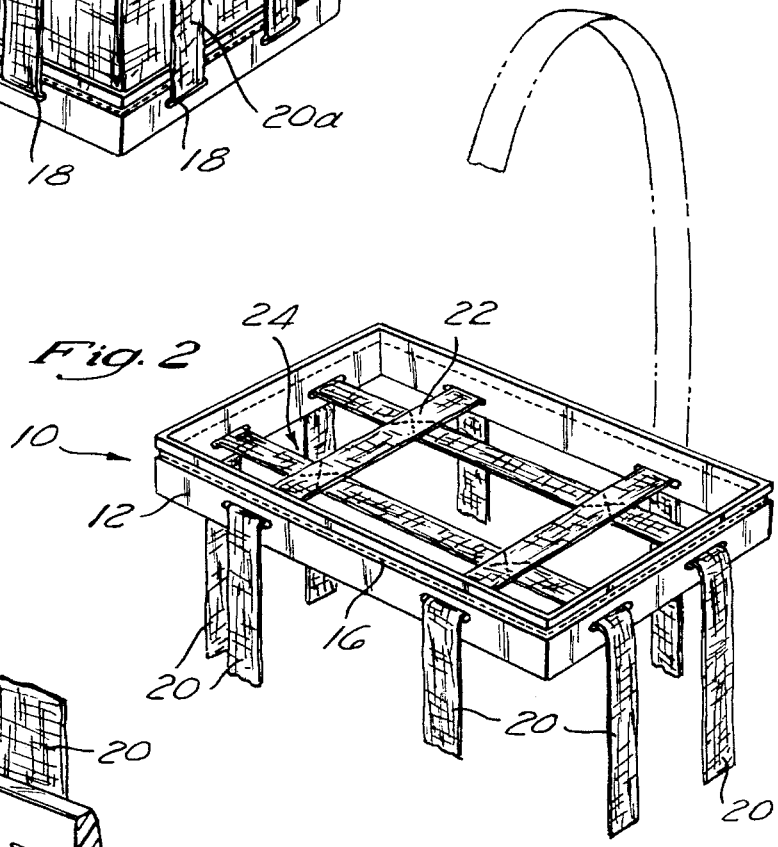
FIG. 2 is a bottom perspective view of the external bag support frame of FIG. 1.
Figure 3:
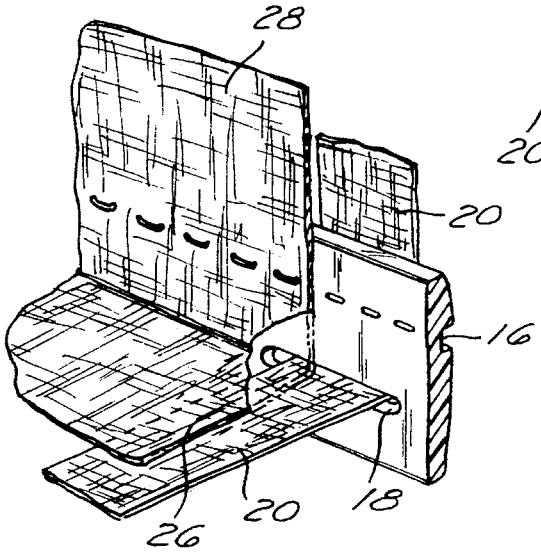
FIG. 3 is a detail in perspective view showing the attachment means of the external bag support frame to the bag.

Referring to FIGS. 1–3, a first embodiment of the external bag support 10 is shown. It has perimeter walls 12 arranged in a shape such as a rectangle, which define an outer perimeter of the bag support 10, into which a bag 14 fits. A stitching well 16 is formed in the perimeter walls 12. A plurality of slot shaped apertures 18 are formed in opposite perimeter walls 12, through which webbing straps 20 are passed. The webbing straps 20 are affixed together, i.e., by stitching 22, to form an undercarriage 24 upon which a bottom wall 26 of the bag 14 is supported. Sidewall 28 of the bag 14 are attached by sewing and/or adhesive to the perimeter walls 12 by stitching line along the stitching well 16. Portions of some or all of the webbing straps **20*a* will optionally extend up on the side walls 28 of the bag 14, and be attached there by stitching 30. Other straps 20*b*, can be used to form carrying handles 30 or shoulder straps for a backpack (not shown). A completed bag 14 united with its external bag support 10 is shown as 32 in FIG. 1. The embodiment of FIG. 1 forms a sturdy yet simple bag which provides additional abrasion resistance in a framework to the bag, and which stiffens the bottom of the bag 14. The external bag support 10** is best formed of material such as rigid or semi-rigid plastic material to provide a lightweight, yet non-marring external support member.

Figure 4:
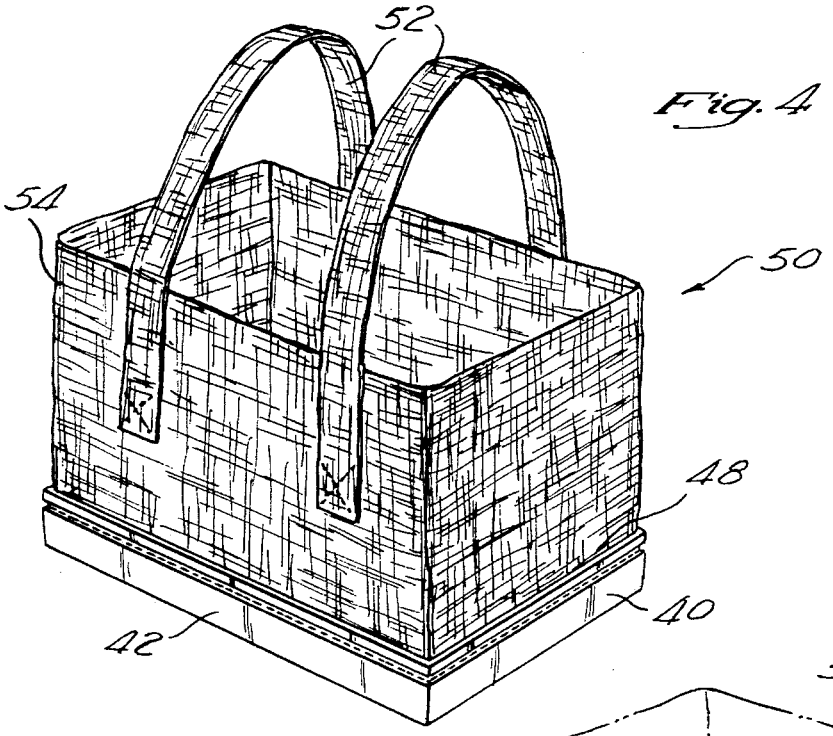
FIG. 4 i a perspective view of another embodiment of an external bag support frame of the invention, attached to an open top bag.
Figure 5:
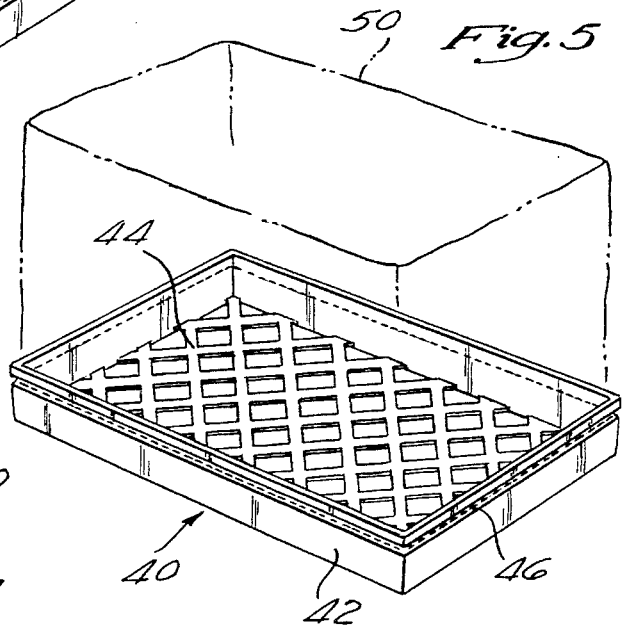
FIG. 5 is a perspective view of the external bag support frame of FIG. 4, with the bag shown in phantom lines.

Referring to FIGS. 4 and 5, a second embodiment of the invention 40 is shown, which has perimeter walls 42 with an integrated grid bottom 44, which is preferably molded as one piece with the perimeter walls 42. A stitching well 46 is formed into the perimeter walls 42 and is used to secure the lower region 48 of the bag portion 50, near the bottom wall of the bag (not shown), to the external bag support frame 40. A pair of loop carrying handles 52 are anchored on walls 54 of the bag.

Figure 6:
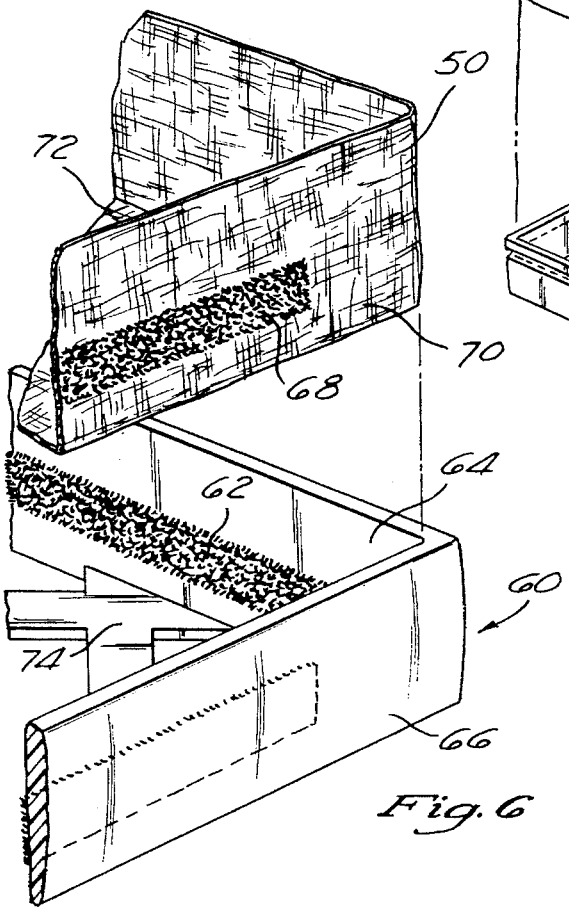
FIG. 6 is a detail in perspective view showing an alternate attachment means of a bag to the external bag support frame.

Referring to FIG. 6, a readily disengageable attachment means to attach the bag 50 to an external bag support frame 60 is shown. A first hook and loop material 62, such as Velcro®, is permanently attached (i.e., by adhesive), to the interior 64 of the perimeter wall 66. Hook and loop material 68 complementary to that attached to the perimeter walls 66 is permanently attached (i.e., by sewing) to lower region 70 of the bag 50, near its bottom 72. Like the embodiment of FIG. 5, the external bag support frame 60 has a bag bottom supporting grid 74 integrally formed therewith. The advantage of this embodiment over those of FIGS. 1–5 is that the bag portion 50 can be readily detached from its external bag support frame 60 for cleaning purposes, or if a lighter weight bag with a less rigid bottom is desired.

Figure 7:
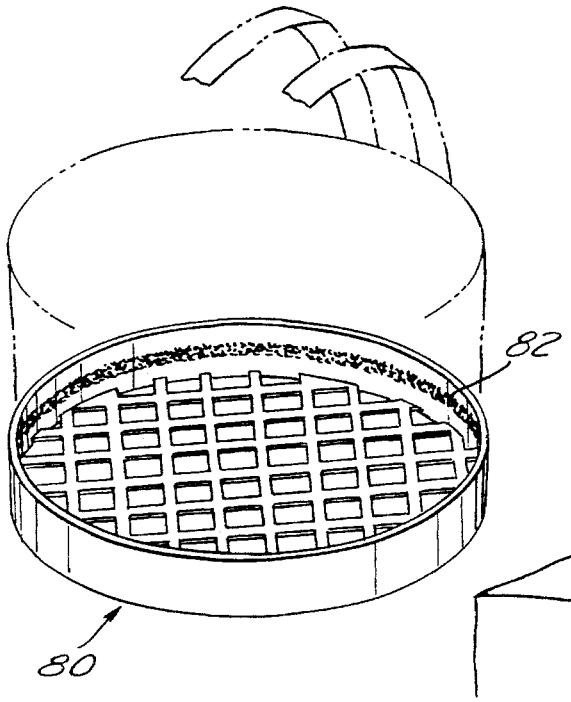
FIG. 7 is a perspective view of a rounded external bag support frame.

FIG. 7 depicts an embodiment of the external bag support frame 80 having a round profile, and which uses hook and loop material 82 to be detachably attached to a bag (shown in phantom lines). If desired, sewing can be used in lieu of the hook and loop material (not shown).

Figure 8:
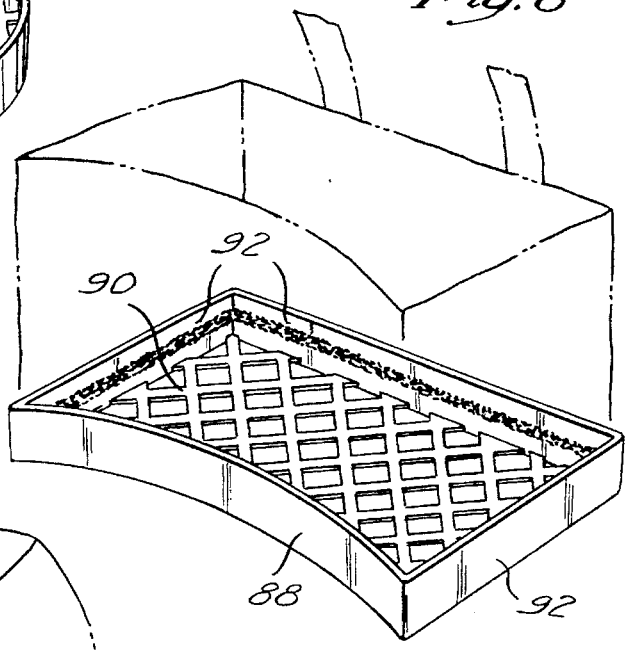
FIG. 8 is a perspective view of an embodiment of an exterior bag support shaped to fit the contour of a backpack wearers back
Figure 11:
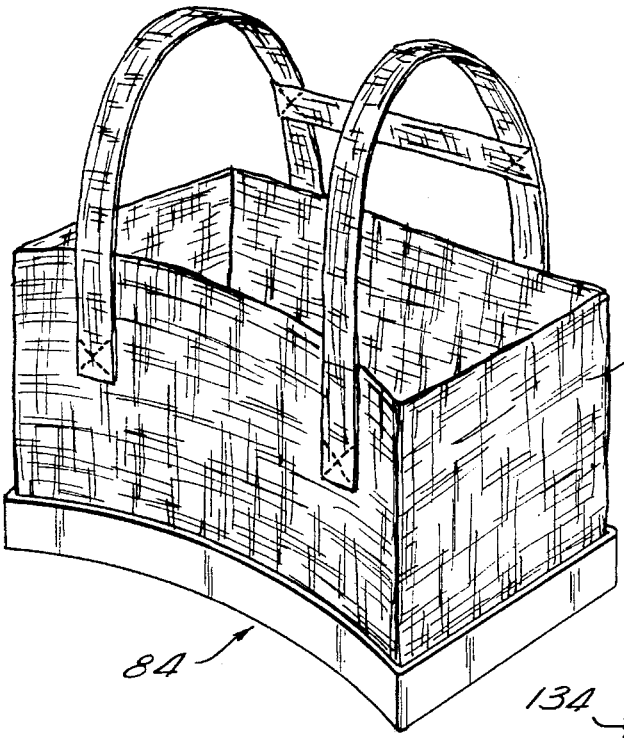
FIG. 11 is a perspective view of the exterior bag support frame of FIG. 8 assembled with its open top backpack.

FIGS. 8 and 11 depict an embodiment of an external bag support frame 84, shaped for use with form fitting backpacks or knapsacks 86. This embodiment has at least one concavely curved perimeter wall 88 which generally follows the shape of a wearer's curved back to provide for better fit and comfort. This embodiment utilizes a grid bottom 90, unitary with the concavely curved perimeter wall 88 and other perimeter walls 92. Hook and loop material 94 can be used to provide for detachable attachability of the backpack 86 to the external bag support frame 84. If desired, sewing can be used instead to provide for permanent attachment.

Figure 9:
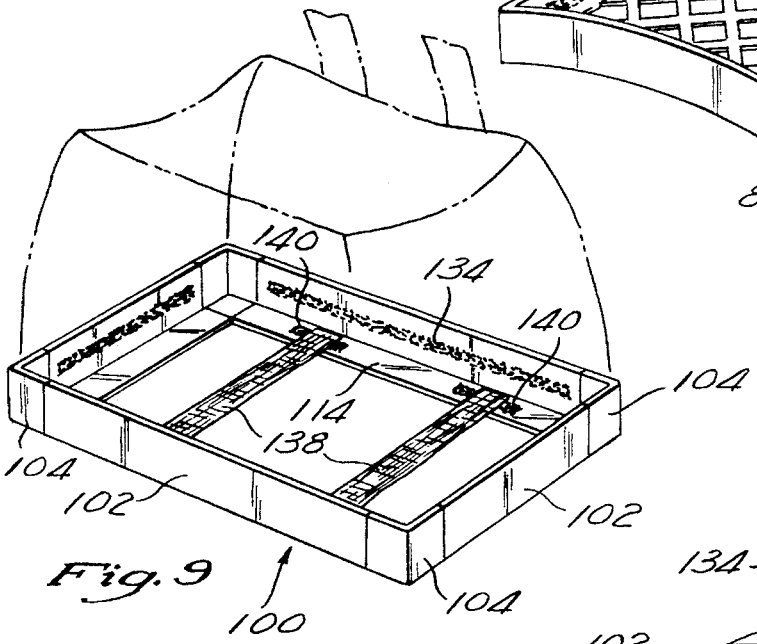
FIG. 9 is a perspective view of an alternate embodiment of an external bag support frame which is assembled from rail sections and corner pieces.
Figure 10:
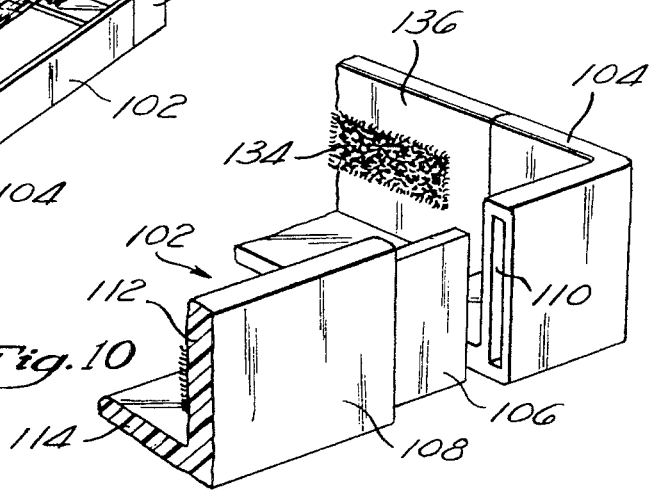
FIG. 10 is a detail in a perspective, exploded view showing a first embodiment of a rail section and a corner piece of FIG. 9.

Referring next to FIGS. 9, 10, 12, and 13 another three alternate embodiments of external bag support frames are shown. In the embodiment of FIG. 10, it is assembled from rail portions 102 and corner portions 104. The rail portion 102 has tongues 106 at its end region 108. The corner portions 104 have slots 110 formed therein, which receive the tongues 106. If desired, immobilizing means such or adhesives, staples, screws, melting and fusion points, and/or snap means (not shown) can be used to hold the rail portions 102 and the corner portions 104 together. The track portion 102 preferably has an L-shaped profile, with a vertical portion 112 and a horizontal portion 114.

Figure 12:
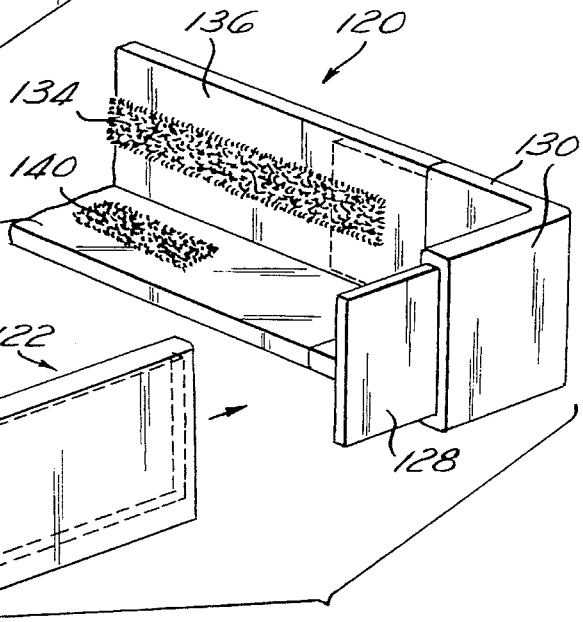
FIG. 12 is a detail in a perspective, exploded view showing a second embodiment of a rail section and a corner piece of FIG. 9.

In the embodiment of the external bag support frame 120 shown in FIG. 12, the rail portion 122 has a slot receiving channel 124 in its vertical wall 126, which is sized to receive a corresponding tongue 128 which extends from both vertical walls 130 of the corner portion 132.

Figure 13:
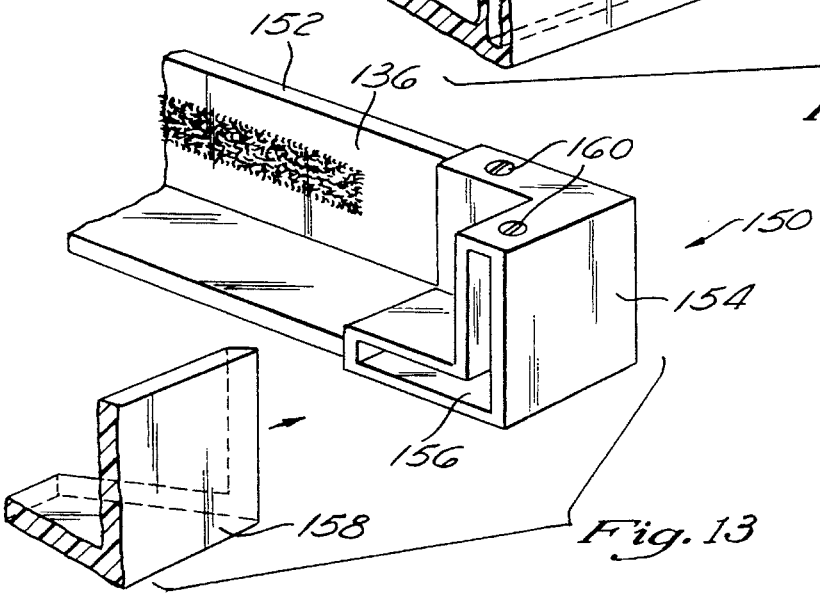
FIG. 13 is a detail in a perspective, exploded view showing a third embodiment of a rail section and a corner piece of FIG. 9.

A third embodiment of an external bag support frame 150 assembled from rail portions 152 and corner portions 154 is shown in FIG. 13. In this embodiment, the corner portion 154 has openings 156 sized to slideably receive the ends 158 of the rail portions 152. Means to interlock the corner portions 154 and rail section 152, such as screws 160 or glue can be used.

In the external bag supporting frames 100, 120 and 150, a first hook and loop material 134 is applied, i.e., with self stick contact adhesive tape, to the inside walls 136 of the track portions 102, 122, and 152. A second hook and loop material (not shown), complementary to the first 134, is attached to the bag in its lower extremity near its bottom, i.e., by self-stick contact adhesive tape or by sewing.

The embodiments of external bag support frames 100, 120, and 150 of FIGS. 9, 10, 12, and 13 are unique in that an end user, with a conventional bag, pack, or sack, can, by simply cutting the rail portion 102, 122, or 152 to the appropriate length, and attaching the hook and loop material to the rails 102, 122, and 152 and bag create the external bag support frames 100, 120, and 150 which perfectly fit the existing bag, pack, or sack. Plastic materials work well for the rail portions 102 and 122 of the frames of FIGS. 9, 10, and 12. Referring to FIGS. 9 and 12, optional bottom support webbing straps 138, which are attachable to horizontal portion 114 of the frame portions 102, 126, and 156 by hook and hoop material 140. These rails and end portions can be supplied in a kit form to enable the end user to retrofit or his or her own bags.

If a user of the external bag support frames 100, 120, and 150 of FIGS. 9, 10, 12, and 13, (i.e., a small manufacturer) has sewing machines with which to sew the external bag support frames 100, 120, and 150 to a bag, pack, or sack, then this can be done in lieu of the hook and loop material, to provide for more permanent and secure attachment (not shown). Adhesives can also be used.

It should be borne in mind that the drawings are not rendered in actual scale so that certain features of the invention can be brought out and depicted.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

I claim:

1. An external bag support frame for attachment to a bag to provide the bag with additional rigidity and abrasion resistance, the bag having a bottom wall and side walls, said external bag support frame comprising:

a frame member having perimeter walls with apertures formed therethrough, said frame member being adapted to be attached to the bag's side walls near its bottom wall with attachment means; and webbing straps, wherein said webbing straps are looped through said apertures on opposite perimeter walls of said bag support frame to form a webbing grid to provide for additional support for the bottom wall of the bag, and wherein upper regions of said webbing straps are sewn to the side walls of the bag.

2. The external bag support frame of claim 1, wherein said attachment means comprises stitching lines attaching said perimeter walls of said bag support frame to the side walls of the bag.

3. The external bag support frame of claim 2, wherein said perimeter walls have stitching wells for the stitching lines.

4. The external bag support frame of claim 1, wherein said frame member further comprises a grid bottom, unitary with said perimeter walls, to support the bottom region of the bag.

5. An external bag support frame for attachment to a bag to provide the bag with additional rigidity and abrasion resistance, the bag having a bottom wall and side walls, said external bag support frame comprising:

a frame member having perimeter walls with apertures formed therethrough, said frame member being adapted to be attached to the bag's side walls near its bottom wall with stitching lines; and webbing straps, wherein said webbing straps are looped through said apertures on opposite perimeter walls of said bag support frame to form a webbing grid to provide for additional support for the bottom wall of the bag, and wherein upper regions of said webbing straps are sewn to the side walls of the bag.

6. The external bag support frame of claim 5, wherein said perimeter walls have stitching wells for the stitching lines.

7. The external bag support frame of claim 5, wherein said frame member further comprises a grid bottom, unitary with said perimeter walls, to support the bottom region of the bag.

* * * * *